US012702917B2

(12) United States Patent
Bodytko

(10) Patent No.: US 12,702,917 B2
(45) Date of Patent: Aug. 11, 2026

(54) PHYSICAL 3D CHESS CUBE WITH EXTENDED WALLS

(71) Applicant: Pawel Bodytko, Port Orange, FL (US)

(72) Inventor: Pawel Bodytko, Port Orange, FL (US)

( * ) Notice: Subject to any disclaimer, the term of this patent is extended or adjusted under 35 U.S.C. 154(b) by 44 days.

(21) Appl. No.: 18/768,394

(22) Filed: Jul. 10, 2024

(65) Prior Publication Data

US 2026/0014451 A1 Jan. 15, 2026

(51) Int. Cl.
*A63F 3/00* (2006.01)
*A63F 3/02* (2006.01)

(52) U.S. Cl.
CPC ..... *A63F 3/00214* (2013.01); *A63F 3/02* (2013.01); *A63F 2003/0022* (2013.01); *A63F 2003/00577* (2013.01); *A63F 2003/0058* (2013.01); *A63F 2003/00583* (2013.01); *A63F 2003/0063* (2013.01)

(58) Field of Classification Search
CPC ..... A63F 3/02; A63F 3/00214; A63F 2003/00217–0022
See application file for complete search history.

(56) References Cited

U.S. PATENT DOCUMENTS 3,341,205 A * 9/1967 Dykes ..... A63F 3/00176 273/261
3,359,003 A * 12/1967 Kass ..... A63F 3/00214 D21/348
3,604,709 A * 9/1971 Svetz ..... A63F 3/00214 D21/337
5,193,813 A * 3/1993 Goff ..... A63F 3/00214 273/241
5,860,651 A * 1/1999 Fierro ..... A63F 3/02 273/261
2014/0091524 A1* 4/2014 Metzler ..... A63F 3/02 273/243

FOREIGN PATENT DOCUMENTS

DE 3438151 A1 * 4/1986 ..... A63F 3/00214
DE 102015014306 B3 * 10/2016 ..... A63F 3/00214
(Continued)

OTHER PUBLICATIONS

English machine translation of DE-102015014306-B3 (Year: 2016).*
(Continued)

*Primary Examiner* — Laura Davison

(57) ABSTRACT

A three-dimensional chess apparatus comprising a cube-shaped board with extended walls along certain edges. The cube features a 4×4 checkerboard pattern on each face. Walls extend from edges where adjacent squares are the same color, acting as gameplay barriers and providing ground clearance for pieces on the bottom face. Chess pieces are designed to be shorter than these walls, allowing for stable placement and movement. The game includes Frontier and Crossroads variants affecting pawn movement, and a Revolution variant allowing rotation of cube sections. The apparatus introduces new strategic elements through modified piece movement rules and three-dimensional play. A novel three-digit notation system, with the first digit representing the cube face, enables precise recording of piece positions, accommodating the 3D nature of the game board.

5 Claims, 10 Drawing Sheets

Chess Cube with White Set (A) positioned between white walls and Back Set (B) positioned on the opposite side of the cube between black walls.

(56) References Cited

FOREIGN PATENT DOCUMENTS

| | | | | | |
|---|---|---|---|---|---|
| GB | 2298144 | A | * | 8/1996 | ..... A63F 3/02 |
| NL | 1029027 | C2 | * | 11/2006 | ..... A63F 3/00214 |
| WO | WO-2004076013 | A1 | * | 9/2004 | ..... A63F 3/00214 |
| WO | WO-2006121328 | A1 | * | 11/2006 | ..... A63F 3/00214 |

OTHER PUBLICATIONS

English machine translation of DE-3438151-A1 (Year: 1986).*
"360 Chess on a Cube," Pawel Bodytko, https://www.chess.com/forum/view/chess960-chess-variants/360-chess-on-a-cube, Mar. 24, 2014 (Year: 2014).*
"Chess on a Rubik's Cube," Youtube.com video by carykh, https://www.youtube.com/watch?v=TQDTI9qyfLA, Mar. 21, 2024 (Year: 2024).*

* cited by examiner

Chess Cube with White Set (A) positioned between white walls and Back Set (B) positioned on the opposite side of the cube between black walls.

Showing wall extensions (A) on specific edges (B) and example designs (C) (D)

Showing height of wall extensions (A) compared to the maximum height of chess pieces (B)

Showing Frontier variant with parallel extensions (A), and pawn movements directions (B) (C)

Showing Crossroads variant with perpendicular extensions (A), and pawn movements (B) (C)

Showing Revolution chess cube variant showing possible slice rotations (A) (B) (C)

Showing a home base of the white set initial positions for figures (A) and pawns (B).

Checkers setup on the Crossroads cube variant

Cube mapped onto 2d plane and notation system for the Frontier cube variant.

Cube mapped onto 2d plane and notation system for the Crossroads cube variant.

PHYSICAL 3D CHESS CUBE WITH EXTENDED WALLS

BACKGROUND OF THE INVENTION

Field of the Invention

The present invention relates to the field of chess variants, specifically to three-dimensional chess games. It particularly pertains to physical implementations of 3D chess that aim to enhance strategic complexity while maintaining playability.

Chess, with a history spanning approximately 1,500 years, has inspired numerous variants throughout its evolution. The concept of three-dimensional chess, in particular, has long captivated the imagination of chess enthusiasts and science fiction fans alike. The phrase "playing three-dimensional chess" has entered popular culture as a metaphor for advanced strategic thinking, implying a level of cognitive skill beyond that required for traditional chess.

Despite this cultural fascination, few people have actually played three-dimensional chess in real life. Various attempts to create 3D chess variants have faced significant challenges:

- Overly complex rules or board structures that are difficult for players to visualize and understand.
- Lack of physical stability in the game pieces or board.
- Deviation too far from traditional chess rules, making the games inaccessible to regular chess players.
- Inability to be played as a physical game due to gravitational constraints.

Notable attempts at three-dimensional chess include Raumschach (1907), which used a 5×5×5 board and introduced new pieces, and the Star Trek Tri-Dimensional Chess, which, while visually striking, lacks standardized rules and is more of a prop than a playable game.

Various forms of three-dimensional chess have been proposed throughout history. One notable example is Cylindrical Chess, also called Cylinder Chess. This variant has roots dating back possibly to the early 19th century or even earlier. According to chess researcher Bill Wall, a cylindrical variant was mentioned in a book titled *Muraj adh-dhahab* (Fields of Gold) from 947 AD, although there is some debate about this early reference. More concrete evidence comes from the early 1800s, with the Marquis Teodoro Ciccolini playing on a cylindrical board, and later in 1907, A. Piccinini using the cylindrical board as a theme for chess problems.

A significant prior art in this field is U.S. Pat. No. 5,860,651 (Fierro, 1999), which describes a cubical chessboard with a 4×4 grid on each face. However, this design has several limitations. It lacks extended walls that could serve as both barriers and supports, allowing unrestricted movement across all edges of the cube. This "endless" board can make checkmates more difficult to achieve, potentially leading to more drawn games. Additionally, there is no specification for chess piece height relative to any structural element of the board, which can lead to stability issues in a physical game.

The challenge of creating a physically stable and playable 3D chess set has been addressed in various ways by previous inventors. For example, Dutch Patent NL1029027C2 describes a 3D chess set where the board itself serves as a stand for the game pieces. U.S. Pat. No. 5,860,651 presents a design that incorporates both a stand and a suspension system for the game pieces. Taking a different approach, German Patent DE102015014306B3 introduces a gimbal-mounted full cube chess set, allowing any side of the cube to be positioned horizontally. While these designs provide stability or flexibility, they may have limitations in terms of gameplay dynamics or the ability to transform the board during play.

Many 3D chess concepts have approached the challenge by utilizing multiple 2D boards stacked or arranged in three-dimensional space. This approach is exemplified by the iconic Star Trek 3D chess set, which has captured popular imagination despite lacking standardized rules. Similarly, U.S. Pat. No. 5,193,813 describes a 3D chess game with multiple playing levels, where each level is essentially a separate 2D chessboard. These multi-board approaches introduce vertical movement between levels as an additional strategic element. However, they maintain a fundamental separation between playing surfaces and don't truly integrate the game into a single 3D space.

Another approach to 3D chess involves expanding the playing space significantly beyond the traditional 8×8 board. For instance, U.S. Pat. No. 3,604,709 and UK Patent Application GB2298144A both describe chess variants using an 8×8×8 cube as the playing space. This creates a massive 512-square playing field, dramatically increasing the complexity of the game. While these designs offer an expansive 3D environment, they present significant challenges in terms of gameplay complexity, physical implementation, and player accessibility.

The pursuit of three-dimensional chess has also led inventors to explore various geometric shapes for game boards. U.S. Pat. No. 3,359,003, for example, describes a 3D chess set that can take the form of different polyhedrons, including cubes, tetrahedrons, and octahedrons. This design, like some others mentioned, utilizes gimbal mounts to allow rotation and repositioning of the game board. While these approaches offer interesting geometric variations and flexibility in board orientation, they often require complex rule modifications or present challenges in maintaining piece stability during play.

In recent years, computer technology has spurred new interest in chess variants. Programs and online platforms have made it easier to create and test new variants. However, most of these remain in the digital realm, lacking the tactile and social aspects of physical board games.

In November 2013, the author of the present invention explored a concept for a three-dimensional chess computer program, which was presented as part of a Kickstarter campaign in 2014. This campaign was primarily designed to evaluate Kickstarter as a marketing platform and to gauge public interest in the concept, rather than as a serious funding effort. The digital concept presented in this campaign included several elements similar to the present invention:

- It used a virtual cube with chess patterns on each face, eliminating concerns about gravity and physical support.
- It employed regular-sized chess pieces in a digital environment.
- The cube edges where adjacent squares were the same color were marked as barriers that pieces couldn't cross, though these were not extended walls as in the current invention.
- The concept was designed purely for computer play, without consideration for physical game sets.
- It featured a perpendicular barrier configuration, similar to the Crossroads variant in the current invention.

While this digital concept laid important groundwork, it had several limitations:

- The barriers were solely for gameplay and did not serve as structural supports.

The chess pieces were traditional in design and taller than the barriers, limiting physical adaptability.

It lacked multiple game variants and the ability to switch between configurations.

As a purely digital concept, it didn't address the challenges of creating a physical 3D chess set.

The present invention aims to address these limitations by creating a 3D chess variant that is both intellectually stimulating and practically playable as a physical game. It introduces innovative elements such as extended walls serving dual purposes, multiple game variants, and a transformative gameplay option, while maintaining a connection to traditional chess concepts. By doing so, it seeks to bring the metaphorical concept of "three-dimensional chess" into a tangible, enjoyable reality.

In contrast to these various approaches, the present invention takes a novel approach to 3D chess. Unlike multi-board designs, it uses a single continuous surface as the game board in 3D space. Unlike expansive 8×8×8 cube designs, it maintains a more manageable complexity with a 4×4×6 arrangement, resulting in 96 squares—only 50% more than a standard chessboard. This allows the use of the same number of pieces as traditional chess. The invention also differs from designs with external supports or gimbal mounts by incorporating extended walls that serve both as gameplay barriers and structural supports. This integrated approach creates a truly three-dimensional playing field that is both innovative and accessible, striking a balance between enhanced strategic depth and familiar chess concepts.

SUMMARY OF THE INVENTION

The present invention provides a three-dimensional chess apparatus that addresses the limitations of previous 3D chess designs while introducing innovative gameplay elements. Key features include:

A cube structure with 4×4 grid faces and extended walls along edges where adjacent squares are the same color.

Extended walls that serve dual purposes: as gameplay barriers and as structural supports providing ground clearance for pieces on the bottom face.

Chess pieces designed to be shorter than the extended walls, ensuring stable placement and adherence to game rules.

Two main game variants: Frontier and Crossroads, each with unique wall configurations that fundamentally alter gameplay strategies.

A Revolution variant allowing rotation of cube sections during gameplay, introducing a dynamic, transformative element to the game.

Modified movement rules for pieces, especially pawns, adapted to the 3D environment and specific to each variant.

A comprehensive three-digit notation system for precisely recording moves and positions on the faces of the 3D cube, accommodating all variants including rotations.

Adaptability for playing other games, such as 3D checkers, on the same apparatus.

A reference marker on one of the extended walls to establish consistent orientation for notation and initial setup.

These features combine to create a 3D chess game that is both intellectually challenging and physically playable. The invention offers new strategic depths while maintaining connections to traditional chess concepts, and its physical design solves practical issues that have limited previous 3D chess variants.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein.

Figure 1:
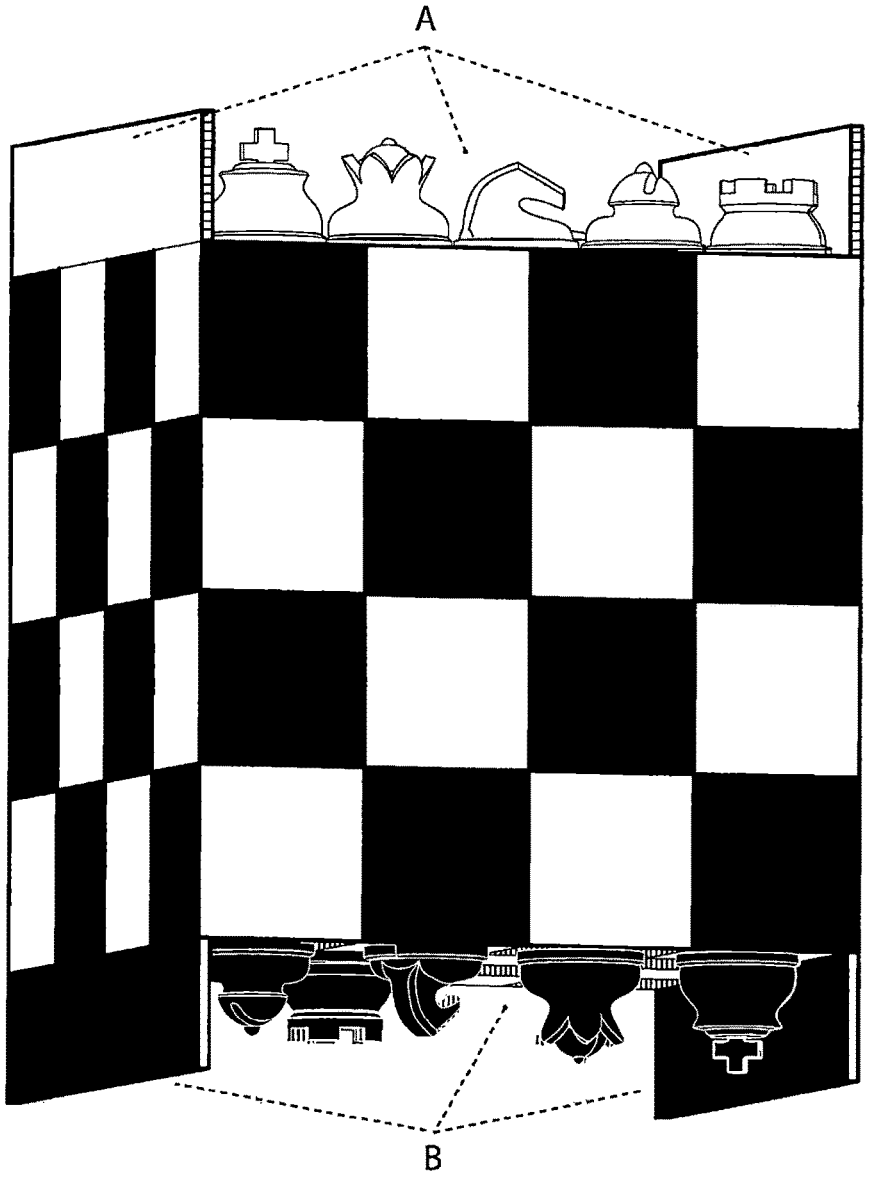
FIG. 1: Chess Cube showing White Set (A) positioned between white walls and Black Set (B) positioned on the opposite side of the cube between black walls.

Cube Structure and Extended Walls: The invention comprises a cube with each face divided into a 4×4 grid of squares in a checkerboard pattern, as shown in FIG. 1. Extended walls are placed along the edges where adjacent squares are of the same color. These walls serve dual purposes:

As barriers that pieces cannot pass through or over during gameplay.

As structural supports allowing the cube to stand independently on any flat surface.

Figure 3:
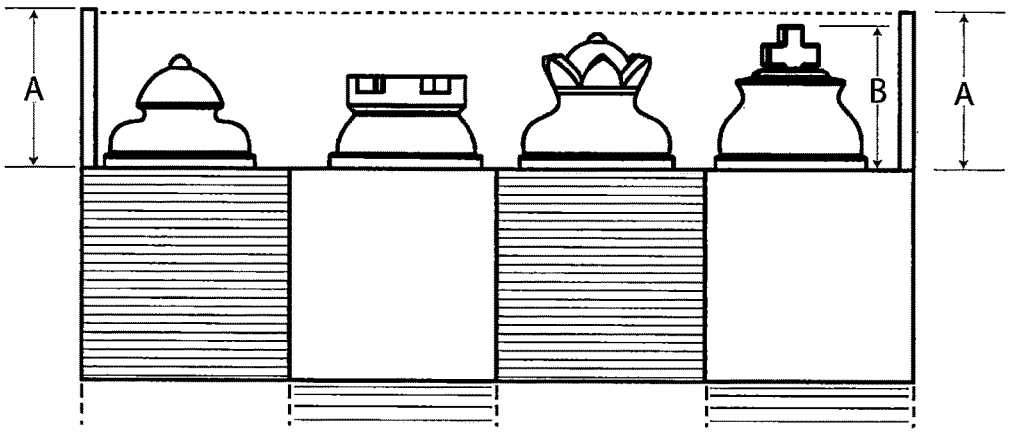
FIG. 3: Comparative height of wall extensions and chess pieces, demonstrating that wall extensions are always taller than the chess pieces.

As illustrated in FIG. 3, the walls are designed to be taller than the tallest chess piece, ensuring their effectiveness as barriers and providing ground clearance for pieces attached to the bottom of the cube. This design allows the cube to be placed on a flat surface without disturbing the pieces on the bottom face.

Figure 2:
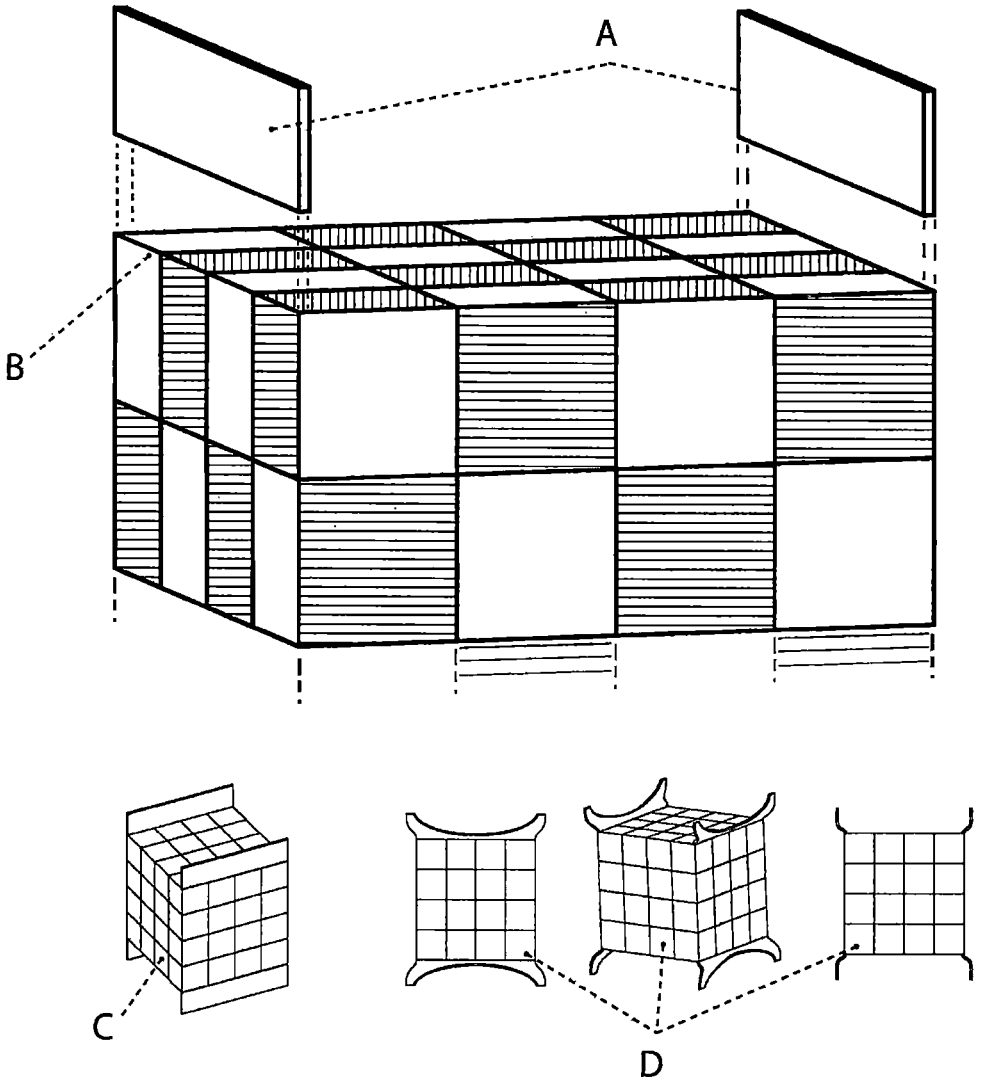
FIG. 2: Illustration of wall extensions on the chess cube, showing various configurations including simple and elaborate wall designs.

The specific shape of the walls (straight, curved, or elaborate) does not affect their functionality, as demonstrated in FIG. 2. This flexibility in wall design allows for aesthetic variations without compromising the core gameplay mechanics.

Piece Attachment Methods: The specific method of attaching chess pieces to the cube faces is not critical to the invention. Various attachment methods can be employed, including but not limited to:

Magnetic attachment: Chess pieces with magnetic bases and magnetic or ferromagnetic material embedded in the cube faces.

Peg and hole system: Pieces with pegs that fit into corresponding holes on the cube faces.

Hook and loop fasteners (e.g., Velcro): Pieces with one side of the fastener and cube faces with the complementary side.

Temporary adhesives: Allowing pieces to be stuck to and removed from the cube faces.

While the inventor's preference is for magnetic attachment due to its ease of use and reliability, the invention is not limited to this method. The choice of attachment method can be based on factors such as manufacturing costs, durability, or user preference, without affecting the core functionality and novelty of the 3D chess apparatus.

Figure 4:
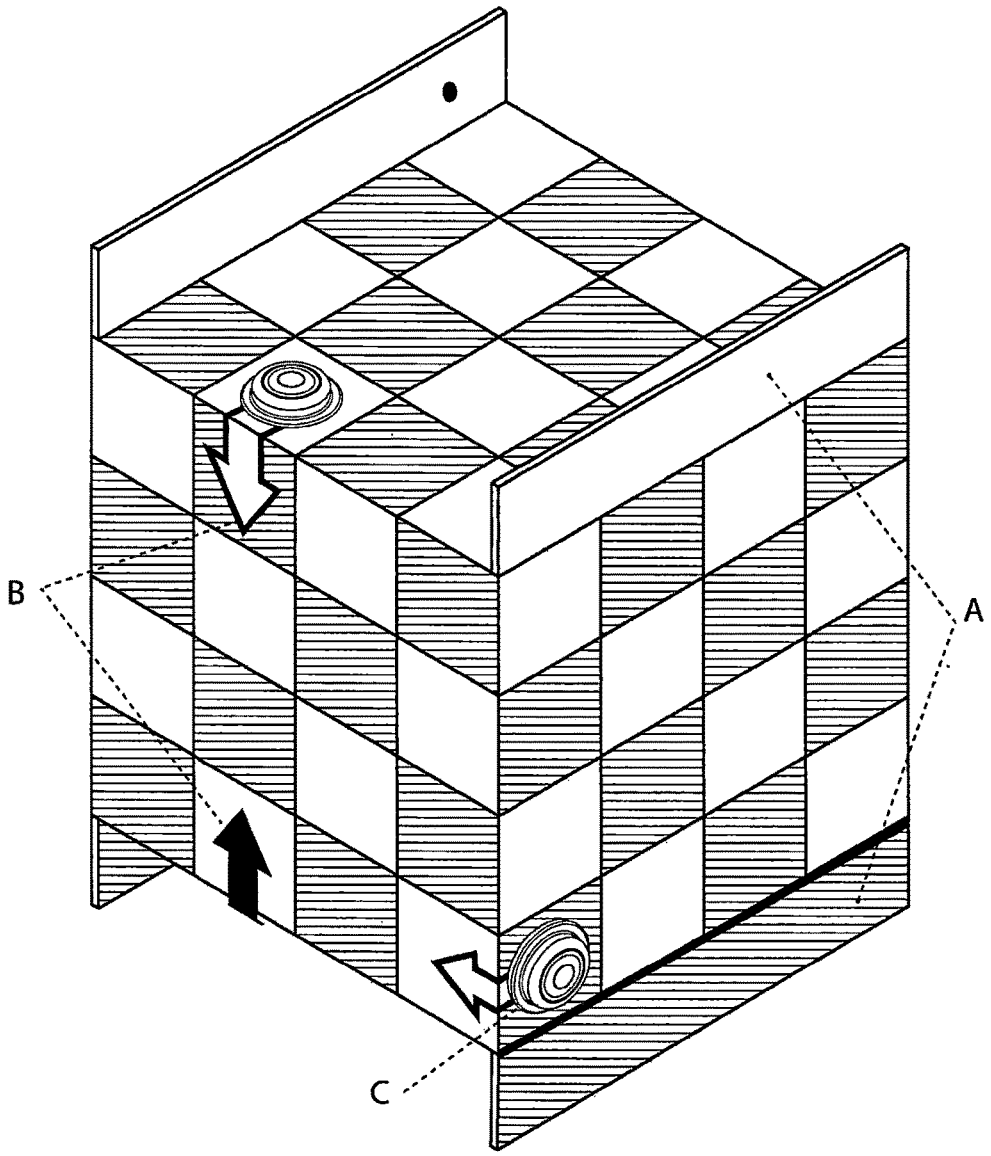
FIG. 4: Frontier Chess Cube Variant configuration, showing wall extensions on the same sides of the cube and illustrating pawn movement rules.

Game Variants: The invention includes three main variants, each offering unique strategic challenges:

Frontier Variant (FIG. 4):

(i) Wall extensions of each home base share the same sides of the cube.

(ii) Pawns follow standard forward movement towards the opposing home base.

(iii) Exception: When a pawn reaches the opponent's home barrier, it may move sideways via the shortest route to circumvent the barrier.

Figure 5:
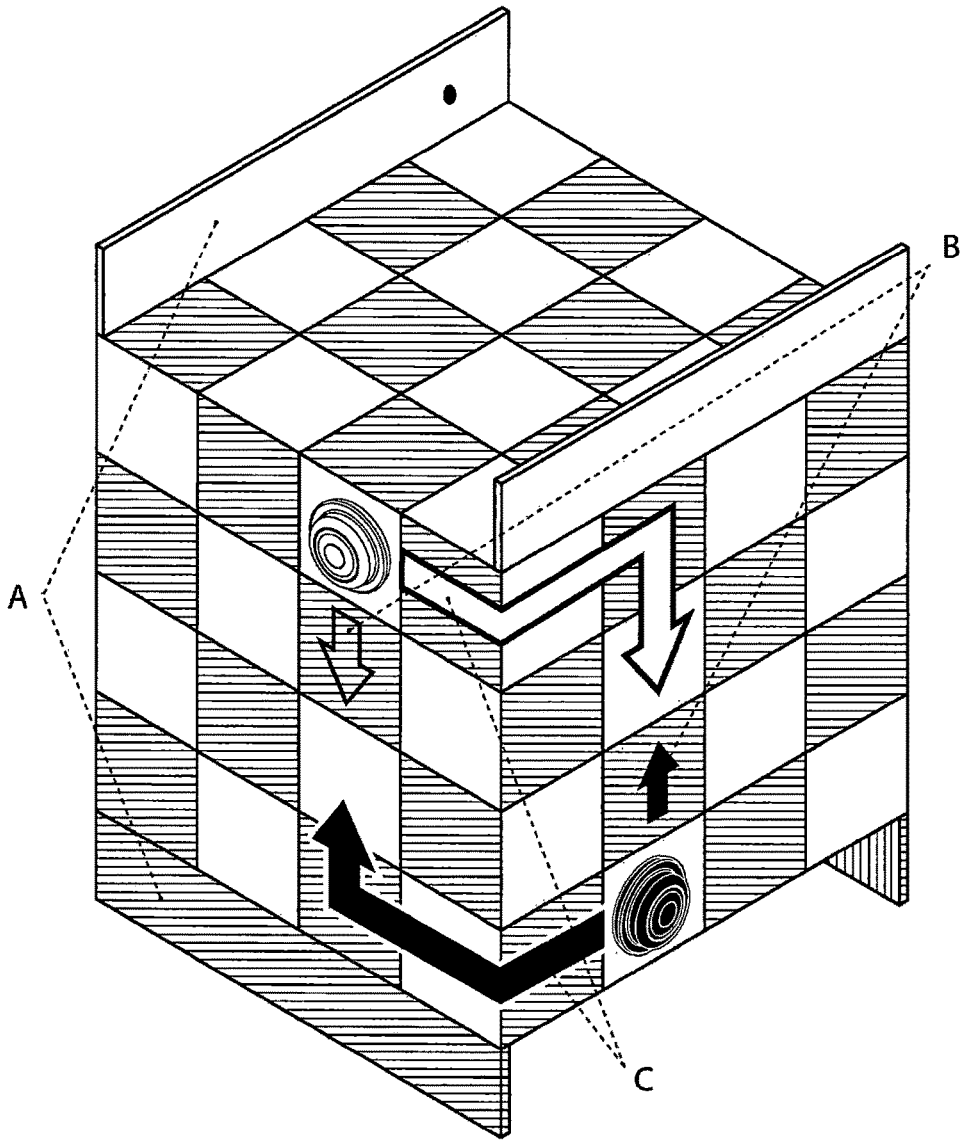
FIG. 5: Crossroads Chess Cube Variant configuration, showing perpendicular wall extensions and illustrating pawn movement rules.

Crossroads Variant (FIG. 5):

(i) Wall extensions of each home base are perpendicular to each other.

(ii) Pawns can move sideways to the middle of the adjacent panel before resuming forward movement.

Figure 6:
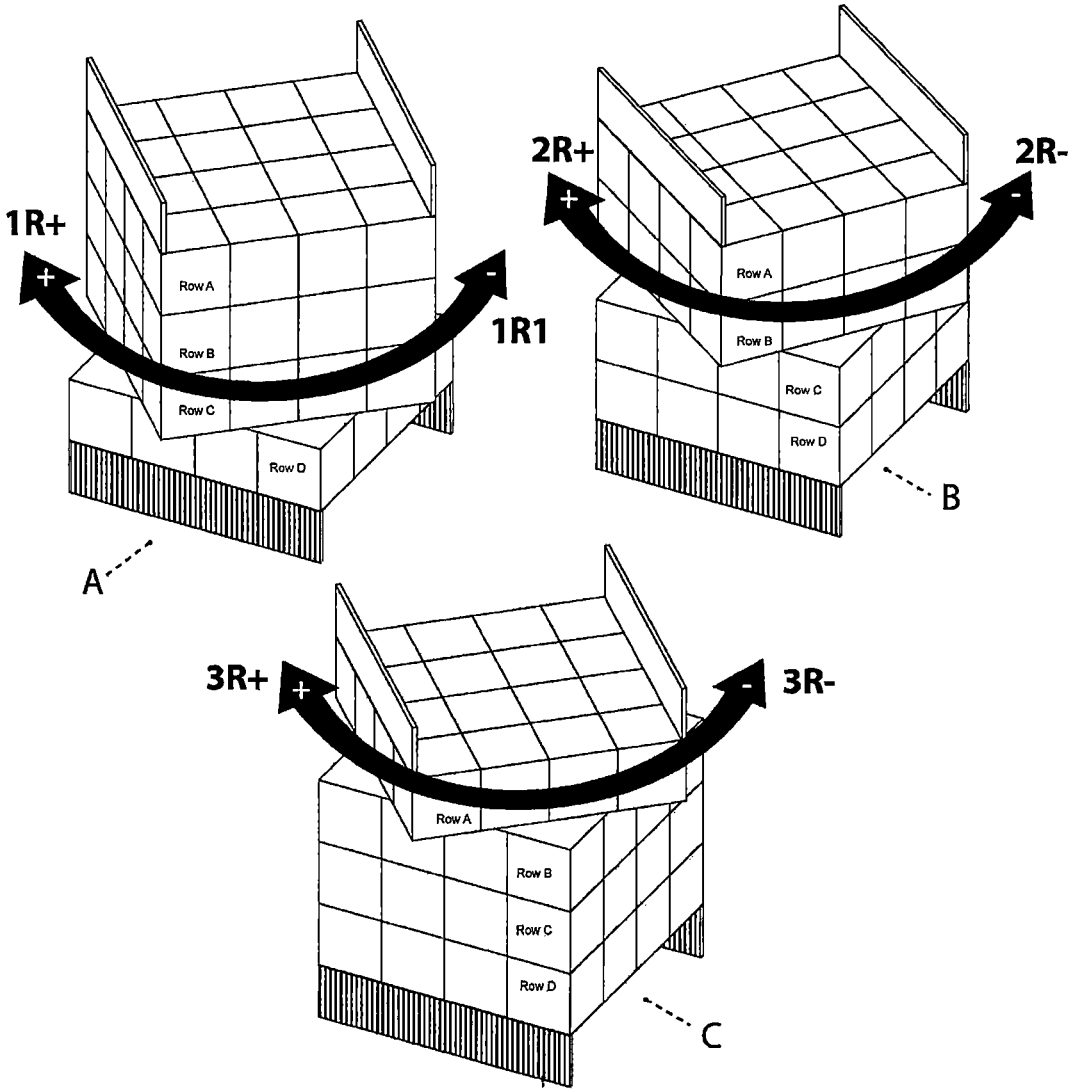
FIG. 6: Revolution Chess Cube Variant, demonstrating cube rotation as part of gameplay and notation method for rotations.

Revolution Variant (FIG. 6):

(i) Allows rotation of cube sections during gameplay.

(ii) Rotations are limited to 90 degrees and occur around a fixed vertical axis.

(iii) The top face of the cube remains fixed and serves as the reference point. Only the bottom layers can rotate. There can be only one boundary of rotation per move. Specifically:

The bottom quarter of the cube can be rotated (boundary between rows C and D).

The bottom half of the cube can be rotated (boundary between rows B and C).

The bottom three-quarters of the cube can be rotated (boundary between rows A and B).

Figure 9:
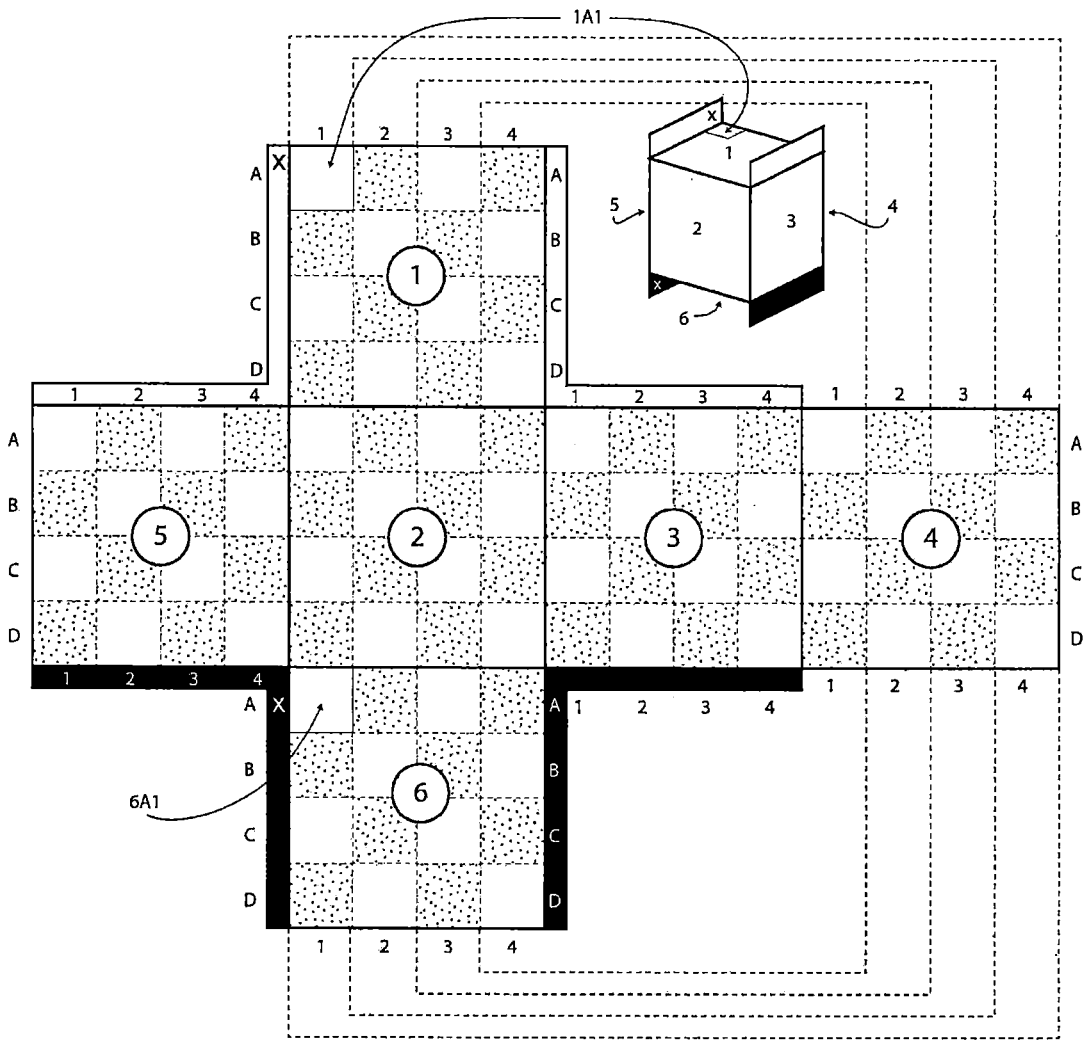
FIG. 9: 2D mapping of cube's 6 sides and notation system for Frontier cube variant.
Figure 10:
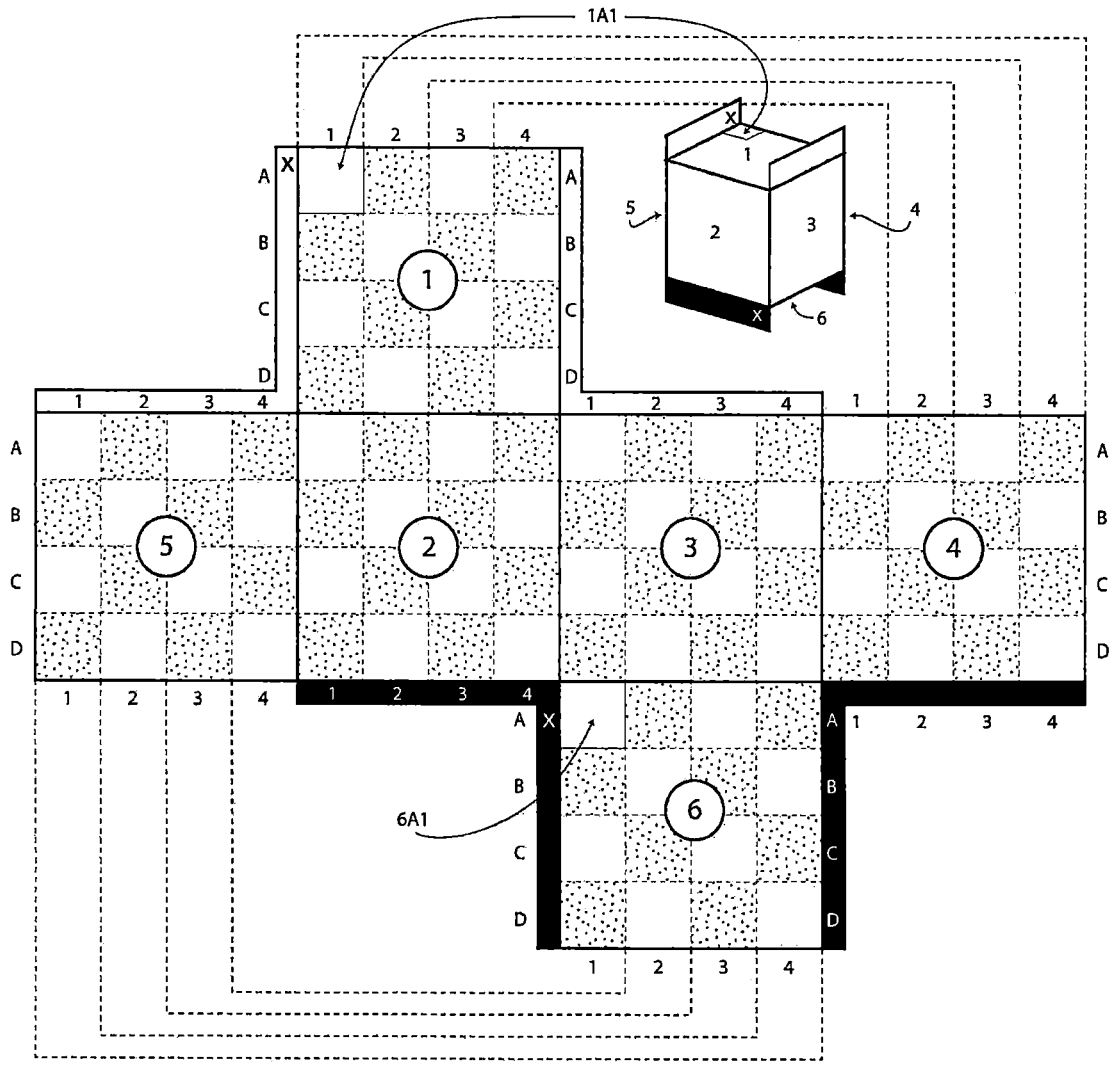
FIG. 10: 2D mapping of cube's 6 sides and notation system for Crossroads cube variant.

(iv) As shown in FIGS. 9 and 10, there are markings for both the 1A1 position (on the White wall) and the 6A1 position (on the Black wall). While the notations for panels 1 and 6 do not change as a result of Revolutions, the orientation of panel 6 will change. These markings allow players to see the current orientation when recording moves, particularly cross-panel moves that involve panel 6.

(v) It is not possible to rotate only the middle sections (e.g., rows B and C alone) while leaving both top and bottom unchanged. Doing so would involve two boundaries rotating in opposite directions, which is not allowed in this variant.

(vi) Rotation is considered a full move.

(vii) Players cannot perform two rotations in consecutive turns or rotate immediately after their opponent's rotation.

(viii) The Revolution variant can be applied to other games played on this apparatus, including 3D checkers, adding a new dimension of strategy to these games as well.

Piece Movement Rules:

Rooks, bishops, and queens cannot move through walls but must navigate around them.

Knights cannot jump over extended walls, altering their movement patterns.

Pawn movement varies based on the variant being played, as described above.

Other pieces move as in traditional chess but must navigate around the extended walls.

Figure 7:
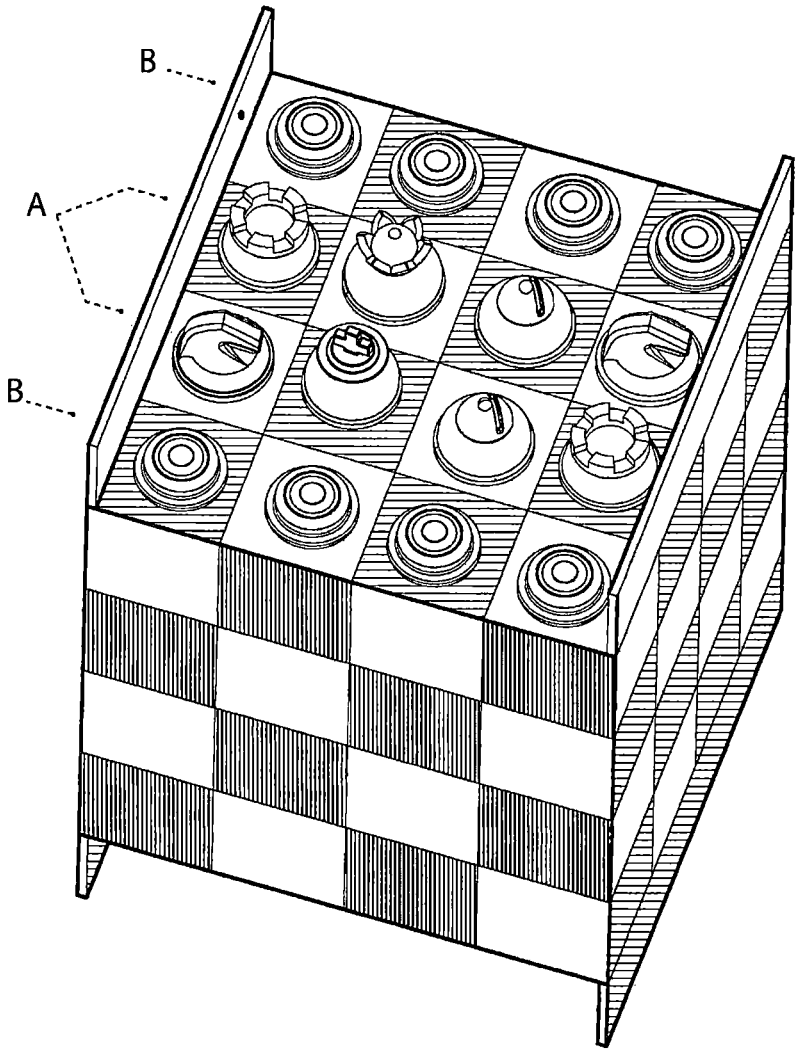
FIG. 7: White set initial positions for chess pieces and pawns on the home base.

The initial setup for the white set is shown in FIG. 7.

Notation System: To accommodate the 3D nature of the game, a novel notation system has been developed:

Each square is identified by a Panel (number 1-6)—Row (letter A-D)—Column (number 1-4) system (e.g., 1A1).

Cube faces are numbered 1-6, with face 1 always being the white player's starting face (top face at game start).

Rotations in the Revolution variant are noted as 1R+, 2R+, 3R+ for clockwise rotations and 1R−, 2R−, 3R− for counterclockwise rotations. The + (clockwise) and − (counterclockwise) directions are always determined with reference to the initial position of the cube, with the white base on top, regardless of any rotations that have occurred during the game.

The number before 'R' indicates the boundary of rotation:

(i) 1R refers to rotation between rows C and D (bottom one-quarter rotate)

(ii) 2R refers to rotation between rows B and C (bottom half rotates)

(iii) 3R refers to rotation between rows A and B (bottom three-quarters rotate)

Rotation effects on piece notation:

(i) R1+ and R1− affect the panel digit for all pieces on Row D of panels 2-5.

(ii) R2+ and R2− affect the panel digit for pieces on Rows C and D of panels 2-5.

(iii) R3+ and R3− affect the panel digit for pieces on Rows B, C and D of panels 2-5.

(iv) For clockwise rotations (+), the panel digit increases by 1 (except panel 5 changes to 2).

(v) For counterclockwise rotations (−), the panel digit decreases by 1 (except panel 2 changes to 5).

(vi) Example: A piece at "3D1" would move to "4D1" with R1+ rotation and to "2D1" with R1− rotation.

This notation system allows for precise recording of moves and game states in all variants, maintaining consistency even as the cube's orientation changes during play. The simple arithmetic nature of the notation changes after rotations makes it easy to track piece positions throughout the game.

FIGS. 9 and 10 illustrate the 2D mapping and notation system for the Frontier and Crossroads variants respectively.

Figure 8:
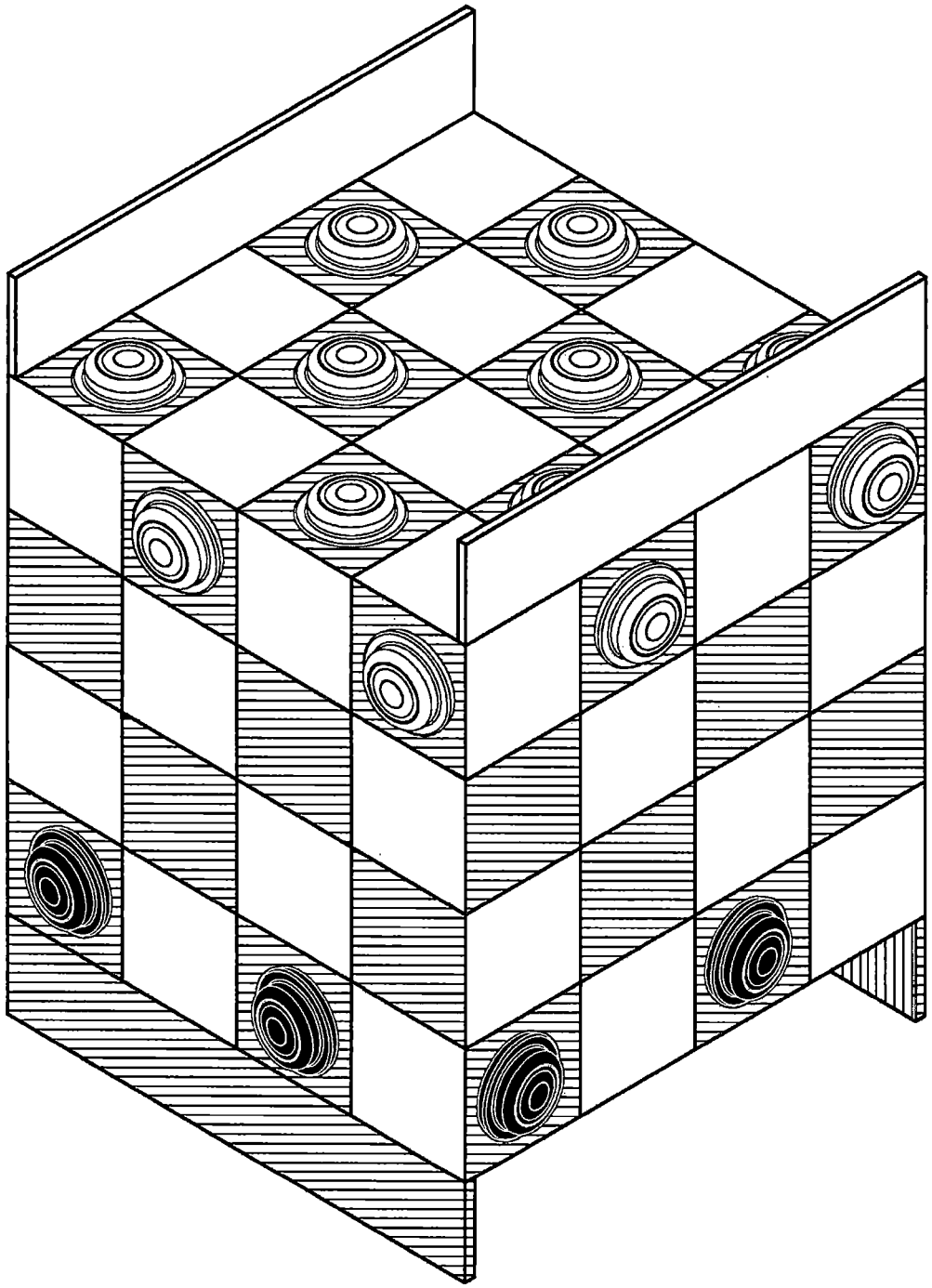
FIG. 8: Checker home base setup and movement directions for 3D Checkers, showing 16 pieces per side and empty middle rows.

Adaptability for Other Games: The apparatus is designed to be versatile and can accommodate other games, such as 3D checkers. FIG. 8 demonstrates the setup for a 3D checkers game, showing 16 pieces per side and empty middle rows.

Reference Marker: A distinct reference marker is placed on the inside of one of the extended walls, adjacent to a specific white square. This marker serves as a reference point for the notation system and ensures consistent orientation for game setup.

Transformative Gameplay: The Revolution variant introduces a unique transformative element to chess. By allowing players to rotate sections of the cube, the game board can change dynamically during play. This adds an unprecedented level of strategic complexity, as players must consider not only their piece movements but also potential board transformations.

In conclusion, this invention provides a novel approach to 3D chess that is both intellectually challenging and physically practical. It addresses the limitations of previous 3D chess designs while introducing innovative gameplay elements. The combination of extended walls, multiple variants, and a transformative gameplay option creates a rich, strategic environment that expands upon traditional chess concepts while remaining accessible to chess enthusiasts.

What is claimed is:

1. A three-dimensional game apparatus comprising:

a) a cube with each face divided into a 4×4 grid of checkerboard squares;

b) extended walls along edges of the cube where adjacent squares are the same color; and c) game pieces designed to be shorter than the extended walls;

wherein the extended walls serve as both barriers to piece movement and as structural supports for the cube.

2. The apparatus of claim 1, wherein the faces of the cube include a first face defining a first home base, a second face defining a second home base opposite the first home base, and four side faces perpendicular to the first and second faces, wherein the extended walls extend from the first home base and from the second home base, and wherein:

a) in a Frontier variant, the extended walls of each home base extend from the same side faces of the cube;

b) in a Crossroads variant, the extended walls of the first home base are perpendicular to the extended walls of the second home base; or c) in a Revolution variant, cube sections are configured for rotation during gameplay.

3. The apparatus of claim 1, further comprising a distinct reference marker on an inside surface of one of the extended walls for use with a notation system for recording moves.

4. The apparatus of claim 1, wherein the game pieces include 16 checker pieces per player.

5. A method of playing a three-dimensional chess or checkers game, comprising:

a) providing the apparatus of claim 1;

b) setting up the game pieces on opposing faces of the cube;

c) moving the game pieces from square to square on faces of the cube, navigating around the extended walls; and d) optionally, in a Revolution variant, rotating sections of the cube 90 degrees around a fixed vertical axis.

* * * * *